United States Patent [19]

Cho

[11] Patent Number: 4,477,816

[45] Date of Patent: Oct. 16, 1984

[54] CORRUGATED ANTENNA FEED HORN WITH MEANS FOR RADIATION PATTERN CONTROL

[75] Inventor: Ching F. Cho, Tujunga, Calif.

[73] Assignee: International Telephone & Telegraph Corporation, New York, N.Y.

[21] Appl. No.: 398,061

[22] Filed: Jul. 14, 1982

[51] Int. Cl.[3] ..... H01Q 13/02

[52] U.S. Cl. ..... 343/786

[58] Field of Search ..... 343/786, 779, 781 R

[56] References Cited

U.S. PATENT DOCUMENTS 3,274,603 9/1966 Kay ..... 343/786

3,631,502 12/1971 Peters et al. ..... 343/786

OTHER PUBLICATIONS

De Melo; Improved Primary Radiator for the IIGHZ Band; Electrical Communication, vol. 54, No. 2, 1979, pp. 125–129 343–786.

*Primary Examiner*—Eli Lieberman

*Attorney, Agent, or Firm*—T. E. Kristofferson; A. D. Stolzy

[57] ABSTRACT

A horn feed for use with a reflector for generating a narrow beam of radiated energy in a radar system. The horn includes surface corrugations and provides a unique configuration of horn flare angle, length of the corrugation pattern along the horn inside surface in the direction of radiation and the cross-sectional dimension of the horn at the beginning of the corrugation pattern, for the minimization of sidelobe generation and optimum illumination of the reflector.

8 Claims, 3 Drawing Figures

CORRUGATED ANTENNA FEED HORN WITH MEANS FOR RADIATION PATTERN CONTROL

BACKGROUND OF THE INVENTION

1. Field of the Invention

The invention relates generally to beam-forming antenna systems and more specifically to microwave reflector type antennas with horn illuminators.

2. Description of the Prior Art

The combination of a parabolic or partially parabolic reflector illuminated by a horn antenna is one of the earliest antenna system arrangements employed in radar systems for the generation of a highly directive beam in space, and accordingly is extensively described in the technical literature. The text "Antenna Engineering Handbook," Henry Jasik, Editor (McGraw-Hill 1961) provides an overview of the art in that respect in Chapter 25, section 25.2, entitled "Radar Antennas," and also describes the state of the art in respect to horn antennas per se in its Chapter 10. From these descriptions and their extensive bibliographical references, a quite complete background in the pertinent prior art in the environment of the invention is obtainable.

For ultralow-sidelobe performance in a reflector antenna with horn feed, the precise pattern shape of the feed horn is very important. The near-in (in angle) sidelobe is very sensitive to the pattern shape of the feed horn from the beam peak (0 dB) to approximately −10 dB. At larger angles from the said horn access (line of boresite), the sidelobe level is likely to be dominated by the "spillover lobe." Although such a spillover lobe can be reduced by increasing the size of the reflector, such an approach may not be acceptable because of size and weight constraints.

The manner in which the invention controls the pattern of the horn feed itself so that it drops off rapidly as a function of increasing angle from the horn axis, while also providing a desirable reflector illumination distribution, will be understood as this description proceeds.

SUMMARY

The approach employed for horn pattern control according to the invention is relatively simple and inexpensive compared to other expedients, such as increasing reflector size, for pattern control. The corrugated horn according to the invention controls the horn pattern at levels below −10 dB to make it drop off rapidly as a function of increasing angle from the horn axis, and at the same time optimize the general shape of the pattern in the 0 dB to −10 dB range. Actually, according to the invention, the concept and implementation of the invention involves control of the less than −10 dB pattern and the 0 to −10 dB pattern substantially independently in a wide-angle corrugated horn with a non-corrugated section adjacent to the horn throat.

It is known that pattern shape control for a corrugated horn as a function of the flare angle $\theta$ and the length of the flared surfaces of the horn can be achieved. In the development of the invention it was found that the E plane width at the inner extremity of the corrugated portion of the horn walls between the intersections of the said E plane with the line of transition from corrugated to smooth walls within the horn controls the shape of the horn pattern from the peak along its axis (0 dB) to the −10 dB level thereof.

According to the invention, it is therefore possible to control and optimize the illumination of an associated reflector at angles subtending the arc of the reflector outline on either side of the antenna axis (boresite) while also minimizing sidelobes at greater angles from the horn axis, energy at these greater angles comprising sidelobe energy producing spillover beyond the perimeter of the reflector. Thus, a horn and reflector system according to the invention conserves radio frequency energy, makes possible a desired illumination gradient about the reflector surface, and tends to avoid the undesirable effects produced by spillover energy.

The details of the concepts and implementation of the present invention will be understood from the description hereinafter.

DETAILED DESCRIPTION

Figures 1, 2:
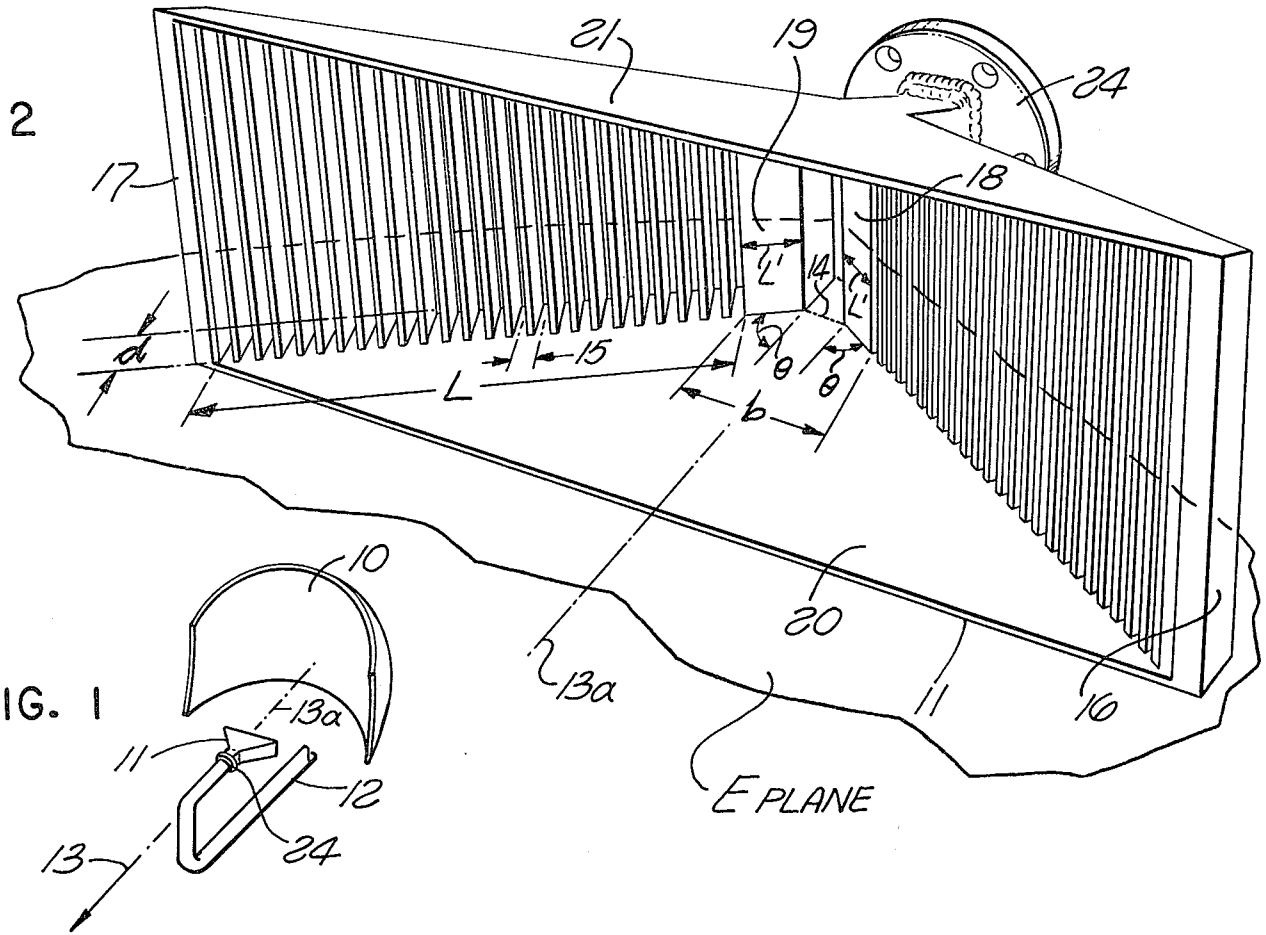
FIG. 1 is a pictorial illustrating the combination of a horn according to the invention and a conventional reflector.
FIG. 2 is a perspective drawing of a pyramidal horn employing the invention.

Referring now to FIG. 1, a conventional doubly curved reflector 10 is shown illuminated by a horn antenna 11 energized from an offset feed 12. The reflector 10 has its largest dimension in the azimuth plane and it may be said that the azimuth plane passing through the center of reflector 10 has an intersection with the curvature of the reflector which is substantially parabolic. In the vertical plane, such a reflector may have a considerably modified shape for the purpose of reducing radiation at low angles and/or for producing a so-called cosecant-squared pattern at higher angles in the elevation plane. Basically, the invention deals with the formation of the azimuth beam shape in this context, however, it is to be understood that the entire system could be rotated 90° about the boresite 13 of the antenna system so that the characteristics to be described would obtain in the vertical plane.

In accordance with the foregoing, for the sake of illustration, it will be assumed that the characteristics of the beam pattern in azimuth are the ones of concern in accordance with the invention.

Figure 3:
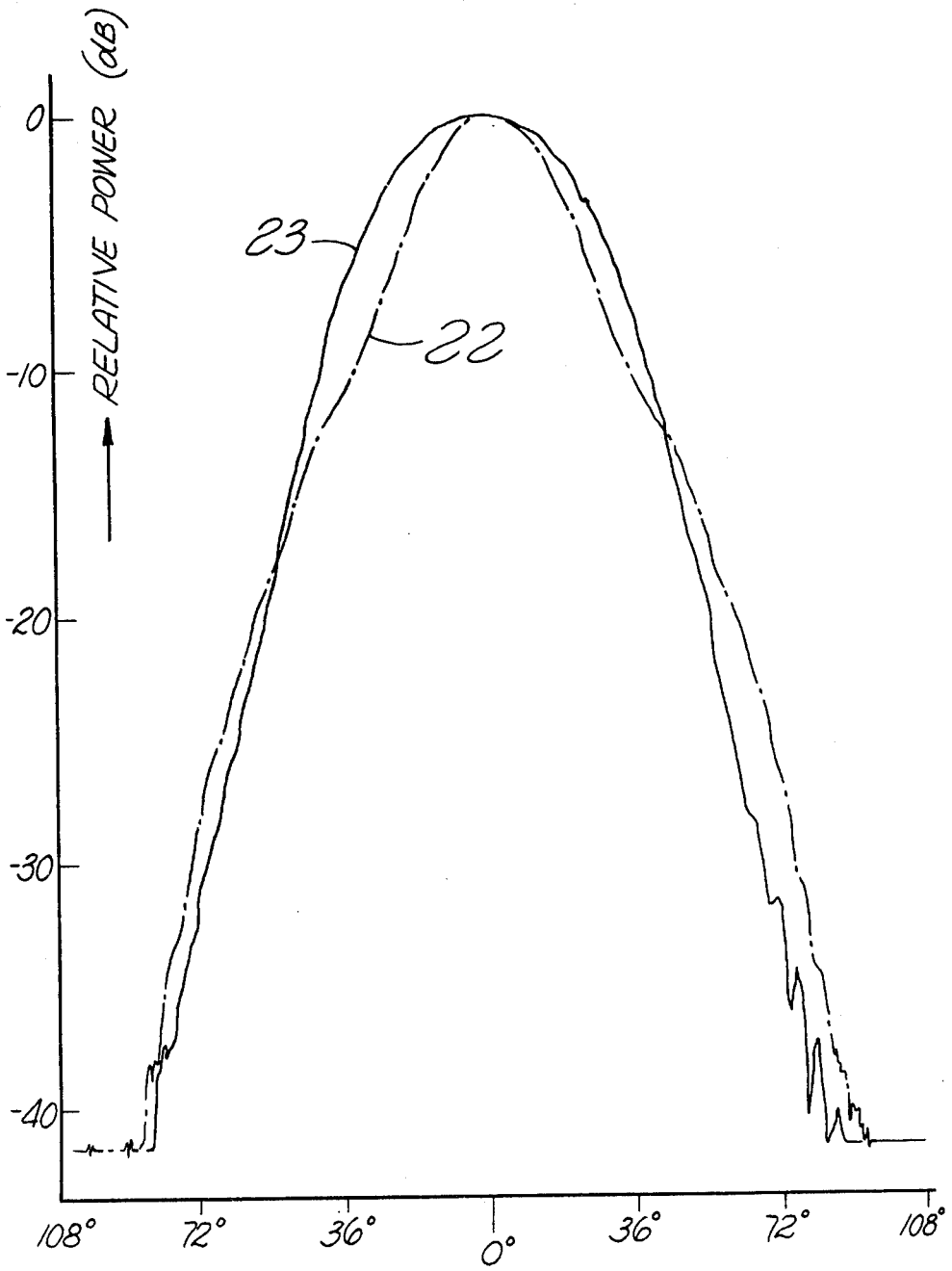
FIG. 3 presents comparative radiation patterns of a horn according to the invention and the equivalently measured radiation pattern of a prior art corrugated horn.

In FIG. 1, 13 represents the axis (boresite) of the horn and reflector combination, and in FIGS. 1 and 2, 13*a* represents the axis (0 dB) point on the radiation pattern as shown in FIG. 3, for the horn according to the invention (in free space).

Referring now to FIG. 2, a detailed pictorial showing of the horn 11 is presented. In this case the greatest dimension of the aperture of horn 11 is parallel to the E plane, i.e., a horizontal plane for convenience of description.

The horn 11 illustrated in FIG. 2 will be seen to have two sets of opposite walls, 16 and 17 as the corrugated walls and 20 and 21 as the smooth walls. The horn 11 could be of the sectorial type in which walls 20 and 21 were essentially parallel, however, in combination with the reflector 10, it would be expected that there would be some flare of the walls 20 and 21 to accommodate the desired illumination of reflector 10 in the plane normal to the E plane. The horn walls 20 and 21 could be supplied with corrugated walls in a special situation such as one in which circular or switchable polarization transmission characteristics were required, however, it is not considered necessary to describe such a variation in detail since the principles of the present invention, once understood, could be applied in that as well as other variations.

The flare angle $\theta$ (half the total included angle of the horn corrugated side surfaces) is identified in two places on FIG. 2. The length L and depth d of the corrugations are identified on FIG. 2 as is the center-to-center spacing 15 of the corrugations along the dimension L.

The waveguide feed 12 will be understood to couple to the horn by means of a flange 24. Such a coupling is a mechanical convenience only and not a functionally necessary part of the combination of the invention. As the waveguide interfaces with the horn flare, a throat is produced having a dimension parallel to the E-plane shown at 14 which will be understood to be equal to the waveguide narrow cross-sectional dimension. Two non-corrugated sections of sidewall 18 and 19 are illustrated, each having a dimension L', the corrugations beginning outwardly beyond the non-corrugated flared walls 18 and 19. For the sake of description, the part of a plane normal to the horn axis 13*a* and also normal to the E plane which has the dimension b as illustrated defines the transition between the corrugated walls and the non-corrugated wall sections 18 and 19. The dimension b is thus along a line parallel to 14 as illustrated.

It has been determined experimentally that, for $\theta > \sin^{-1}(0.8\lambda/b)$, the principal useful portion of the horn radiation pattern is controlled mainly by the dimension b, which is in effect a dimension of the aperture of the non-corrugated horn portion 18 and 19. That dimension is obviously proportional to the spacing of the so-called transition plane from the mouth of the horn. In fact, the 0 to −10 dB portion of the overall horn is quite similar to that obtained with an ordinary smooth walled horn with aperture b and flare angle $\theta$. In the horn according to the invention, the pattern at levels lower than −10 dB (corresponding to greater angles from the horn axis) is controlled by b, $\theta$ and L, provided that $d \gtrsim \lambda/4$, $L > 2\lambda$, $\theta < 80°$, and that there are 6 to 8 corrugations per wavelength. The smaller $\theta$ is made, so long as it is not less than $\sin^{-1}(0.8\lambda/b)$, or the longer L is made, the faster the pattern (as a function of angle from the horn axis) will drop off beyond the −10dB level.

Of course, in speaking of levels, such as −10 dB, etc., it is to be understood that such reference points are arbitrary and not exact function of angles from the horn axis, although the mathematical relationships are generally accurate descriptions of the parameters and conditions.

Referring back to FIG. 1, the horn 11 will be recognized as being placed at or near the focus of the parabolic sheet 10, at least in the E plane (azimuth plane as depicted). Accordingly, the ideal illumination function or pattern shape from the horn itself would be one which would provide the desired illumination function, i.e. uniform for high gain, gaussian or cosine square taper for low sidelobes, from the horn at angles on both sides of the horn axis 13*a* extending to the edge of the reflector 10, but dropping sharply to substantially zero at greater angles. Such an ideal pattern would be tantamount to zero sidelobes and a zero "spillover" problem. Obviously, such an idealized illumination function is not practically possible, however, in connection with FIG. 3 the improvement realized in accordance with the principles of the invention can be better explained.

Referring now to FIG. 3, a pattern 22 is shown in which the dimension b was empirically selected at approximately one and one-third wavelengths. That dimension corresponds to 2.800 inches at a 5.65 GHz operating frequency. In some applications, it is desirable to increase the −10 dB beamwidth in order to optimize the gain and sidelobe levels, and to decrease the −30 dB beamwidth in order to minimize the spillover lobe. Such a modification cannot be accomplished by changing L and $\theta$ alone: However, L' provides a very useful parameter by which the pattern shape can be controlled. The shape shown by the radiation pattern 23 of FIG. 3 provides much more uniform illumination in this 0 to −10 dB region while reducing the effective beamwidth at −30 dB. The desired pattern of 23 is achieved by reduction of the b dimension to 1.845 inches. Those b dimensions all assume a 5.65 GHz design center frequency and in the case of B = 1.845 inches, this becomes $0.883\lambda$.

The desired pattern 23 depicted on FIG. 3 will be seen to afford more uniform illumination in the 0 to −10 dB range while still providing a narrower overall beamwidth at the −30 dB points (corresponding to the reflector edges).

Considered independently with other parameters fixed, increasing L narrows the entire horn radiation pattern. Narrowing the b dimension and increasing L by a proper amount narrows the beam width at levels below −10 dB with little effect on the beam between 0 and −10 dB.

It will be apparent to those of skill in this art that, for different reflector configurations, a basic combination of factors $\theta$, L, and b might be required, however, the principle teaching attributable to the invention is the hitherto unknown and unrecognized significance of the b dimension in controlling the pattern shape.

In the course of generating an empirical design, a fully corrugated horn can provide a starting point. The dimension L' can be introduced stepwise through the application of a conductive foil over the corrugations from the throat of the horn.

What is claimed is:

1. An electromagnetic horn antenna comprising: a rectangular waveguide: a hollow body having a predetermined E plane flare angle and having a throat connecting to said rectangular waveguide, said body having a first pair of opposing flared internal walls and a second pair of parallel internal walls; a plurality of uniformly spaced corrugations in said first pair of walls, said throat having flared uncorrugated portions adjacent corrugations in each of said first pair of walls, dividing lines between said uncorrugated portions and said corrugations defining a transition plane normal to the axis of said body, said corrugations having their elongated dimensions extending substantially perpendicular to said E plane and substantially from the outer extremity of said horn over a predetermined dimension L measured along each of said first walls toward said throat to the intersection of said transition plane, said transition plane having an E plane width of b, such that $\sin^{-1}(0.8\lambda/b)$ is less than the E plane flare angle $\theta$ of said horn.

2. A horn antenna according to claim 1 in which there are at least six of said corrugations per wavelength of the operating frequency.

3. A horn antenna according to claim 1 in which said corrugations have a center-to-center spacing along said dimension L between $\lambda/8$ and $\lambda/6$.

4. A horn antenna according to claim 1, 2 or 3 in which said corrugations have a depth d greater than $\lambda/4$.

5. A horn antenna according to claim 1 in which said dimension L is greater than $2\lambda$ and said flare angle $\theta$ is less than 80°.

6. A horn antenna according to claim 5 in which said corrugations have a depth d greater than $\lambda/4$.

7. A horn antenna according to claim 5 in which said corrugations have a center-to-center spacing along said dimension L between $\lambda/8$ and $\lambda/6$.

8. A horn antenna according to claim 1 in which said corrugations extend over said dimension L with spacing between $\lambda/8$ and $\lambda/6$, said dimension L is greater than $2\lambda$, said flare angle is less than 80° and said corrugations have a depth of at least $\lambda/4$.

* * * * *